US011988461B2

(12) United States Patent
MacDonald et al.

(10) Patent No.: US 11,988,461 B2
(45) Date of Patent: May 21, 2024

(54) ADDITIVE AIRFOIL HEAT EXCHANGER

(71) Applicant: Hamilton Sundstrand Corporation, Charlotte, NC (US)

(72) Inventors: Malcolm MacDonald, Bloomfield, CT (US); Kathryn L. Kirsch, Manchester, CT (US); Abbas A. Alahyari, Glastonbury, CT (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 0 days.

(21) Appl. No.: 17/644,017

(22) Filed: Dec. 13, 2021

(65) Prior Publication Data

US 2023/0184496 A1 Jun. 15, 2023

(51) Int. Cl.

| | |
|---|---|
| ***F28F 1/02*** | (2006.01) |
| ***F28D 1/053*** | (2006.01) |
| ***F28F 1/08*** | (2006.01) |

(52) U.S. Cl.

CPC ..... *F28F 1/022* (2013.01); *F28D 1/05383* (2013.01); *F28F 1/08* (2013.01)

(58) Field of Classification Search

CPC ..... F28F 1/022; F28F 1/08; F28D 1/05383
USPC ..... 165/175
See application file for complete search history.

(56) References Cited

U.S. PATENT DOCUMENTS

| | | | | |
|---|---|---|---|---|
| 1,958,364 A | | 5/1934 | Govers | |
| 3,885,936 A | | 5/1975 | Limebeer | |
| 4,577,684 A | * | 3/1986 | Hagemeister | F28F 1/022 165/172 |
| 4,597,436 A | * | 7/1986 | Hagemeister | F28F 9/0243 165/173 |
| 4,766,953 A | * | 8/1988 | Grieb | B21C 37/151 29/890.039 |
| 5,172,476 A | * | 12/1992 | Joshi | B23P 15/26 228/183 |
| 5,251,692 A | * | 10/1993 | Haussmann | F28F 1/022 165/177 |
| 5,604,982 A | * | 2/1997 | Kent | F28F 1/022 29/890.044 |
| 6,302,197 B1 | * | 10/2001 | Hornby | F28F 1/02 165/173 |

(Continued)

FOREIGN PATENT DOCUMENTS

| | | |
|---|---|---|
| EP | 3480546 B1 | 3/2021 |
| JP | S5221447 U | 2/1977 |
| WO | WO2018083423 A1 | 5/2018 |

OTHER PUBLICATIONS

Extended European Search Report dated Apr. 3, 2023, received for corresponding European Application No. 22212890.2, pp. 9.

*Primary Examiner* — Raheena R Malik
(74) *Attorney, Agent, or Firm* — Kinney & Lange, P.A.

(57) ABSTRACT

A heat exchanger includes a heat exchanger core. The heat exchanger core includes a first fin and a second fin. The second fin is spaced apart from the first fin. The heat exchanger core also includes a primary passage defined between the first fin and the second fin and extending through the heat exchanger core. The heat exchanger core also includes a plurality of airfoils extending through the first fin, the primary passage, and the second fin. At least one airfoil of the plurality of airfoils includes a secondary passage. The secondary passage extends through the heat exchanger core within the at least one airfoil transverse to the primary passage.

18 Claims, 5 Drawing Sheets

(56) References Cited

U.S. PATENT DOCUMENTS

| | | | | |
|---|---|---|---|---|
| 8,234,881 | B2 * | 8/2012 | Yanik | F28D 1/05341 62/515 |
| 9,255,745 | B2 | 2/2016 | Bertolotti et al. | |
| 2010/0006276 | A1 * | 1/2010 | Cremaschi | B21D 53/085 165/173 |
| 2010/0263847 | A1 | 10/2010 | Alahyari et al. | |
| 2011/0030932 | A1 * | 2/2011 | Tucker | F28F 1/32 29/890.047 |
| 2011/0315363 | A1 * | 12/2011 | Matter, III | F25B 39/028 165/173 |

* cited by examiner

ADDITIVE AIRFOIL HEAT EXCHANGER

BACKGROUND

This disclosure relates to a heat exchanger, and in particular, to an additively manufactured heat exchanger.

Heat exchangers are often used to transfer heat between two fluids. For example, heat exchangers are used on aircraft to transfer heat between a relatively hot air source, e.g., bleed air from a gas turbine engine, and a relatively cool air source, e.g., ram air.

SUMMARY

In one example, a heat exchanger includes a heat exchanger core. The heat exchanger core includes a first fin and a second fin. The second fin is spaced apart from the first fin. The heat exchanger core also includes a primary passage defined between the first fin and the second fin and extending through the heat exchanger core. The heat exchanger core also includes a plurality of airfoils extending through the first fin, the primary passage, and the second fin. At least one airfoil of the plurality of airfoils includes a secondary passage. The secondary passage extends through the heat exchanger core within the at least one airfoil transverse to the primary passage.

In another example, a heat exchanger includes a heat exchanger core that includes a first fin extending in a first direction and extending in a second direction, a second fin extending in the first direction and extending in the second direction and spaced apart from the first fin in a third direction. The heat exchanger core also includes a primary passage extending between the first fin and the second fin from a primary inlet to a primary outlet. The heat exchanger core further includes a plurality of airfoils extending through the first fin, the primary passage, and the second fin. Each airfoil of the plurality of airfoils includes at least one secondary passage extending through each airfoil of the plurality of airfoils in the third direction. The heat exchanger also includes a header. The header includes an inlet, a plurality of outlets, and a plenum. The plenum is between the inlet and the plurality of outlets of the header. The plurality of outlets are fluidically connected to the at least one secondary passage of each airfoil of the plurality of airfoils.

Persons of ordinary skill in the art will recognize that other aspects and embodiments of the present invention are possible in view of the entirety of the present disclosure, including the accompanying figures.

Figure 1:
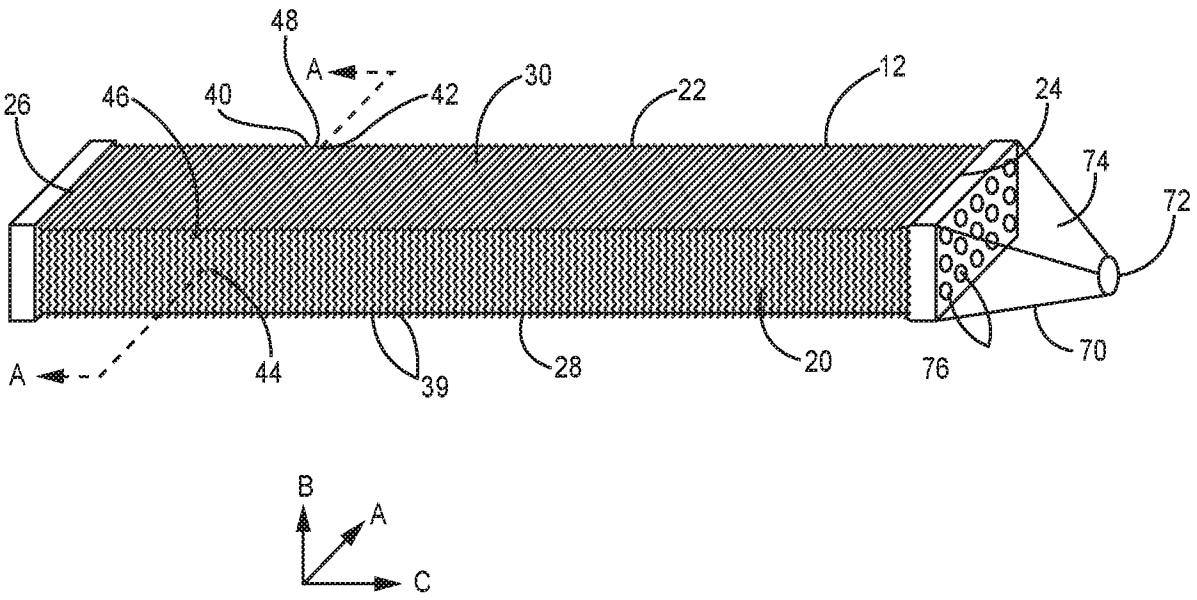
FIG. 1 is a perspective view of a heat exchanger.

While the above-identified drawing figures set forth one or more embodiments of the invention, other embodiments are also contemplated. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features and components not specifically shown in the drawings. Like reference numerals identify similar structural elements.

DETAILED DESCRIPTION

This disclosure relates to an additively manufactured heat exchange that includes a heat exchanger core. The heat exchanger core includes a primary passage defined between a first fin and a second fin that extends through the heat exchanger core. The heat exchanger core also includes a plurality of airfoils that extend within the primary passages from the first fin to the second fin. At least one airfoil of the plurality of airfoils includes a secondary passage that extends through the heat exchanger core within the at least one airfoil transverse to the primary passage. The additively manufactured heat exchanger will be discussed in detail with reference to FIGS. 1-5.

FIG. 1 is a perspective view of heat exchanger 10. Heat exchanger 10 includes heat exchanger core 12 and headers 70. Heat exchanger core 12 includes first side 20, second side 22, third side 24, fourth side 26, fifth side 28, sixth side 30, a plurality of fins 39 that includes first fin 40 and second fin 42, and primary passages 44. Each of primary passages 44 includes primary inlet 46 and primary outlet 48. One of primary passages 44 extends between first fin 40 and second fin 42. Header 70 includes inlet 72, plenum 74, and plurality of outlets 76 (hereinafter referred to as "outlets 76"). Heat exchanger 10 also includes first direction A, second direction B, and third direction C.

Second side 22 is opposite of first side 20. Third side 24 extends from first side 20 to second side 22. Fourth side 26 is opposite third side 24 and extends from first side 20 to second side 22. Fifth side 28 extends from first side 20 to second side 22 and extends from third side 24 to fourth side 26. Sixth side 30 is opposite fifth side 28 and extends from first side 20 to second side 22 and extends from third side 24 to fourth side 26.

First fin 40 extends from first side 20 to second side 22 in first direction A and extends from fifth side 28 to sixth side 30 in second direction B. Second fin 42 extends from first side 20 to second side 22 in first direction A and extends from fifth side 28 to sixth side 30 in second direction B. Second fin 42 is spaced apart from first fin 40 in third direction C. Primary passage 44 extends from first side 20 to second side 22 and from fifth side 28 and sixth side 30 between first fin 40 and second fin 42 from primary inlet 46 to primary outlet 48. Primary inlet 46 is on first side 20 and primary outlet 48 is on second side 22. As shown in FIG. 1, first fin 40 and second fin 42 are corrugated. The corrugation of first fin 40 and second fin 42 helps to provide structural support to heat exchanger core 12 and enable heat exchanger core 12 to be additively manufactured without additional supports. In another example, first fin 40 and second fin 42 can have a sinusoidal, repeating chevron, or any other shape that enables first fin 40 and second fin 42 to be additively manufactured.

Header 70 is on third side 24 of heat exchanger core 12. Plenum 74 is fluidically between inlet 72 and outlets 76. Outlets 76 of header 70 are fluidically connected to secondary passage 64 (first shown in FIG. 2). Header 70 can also be on fourth side 26 of heat exchanger core 12. When header 70 is on fourth side 26 of heat exchanger core 12 header 70 includes inlets 72, plenum 74 and outlet 76. Inlet 72 are fluidically connected to secondary passage 64 opposite of header 70 on third side 24 of heat exchanger core 12.

Figure 2:
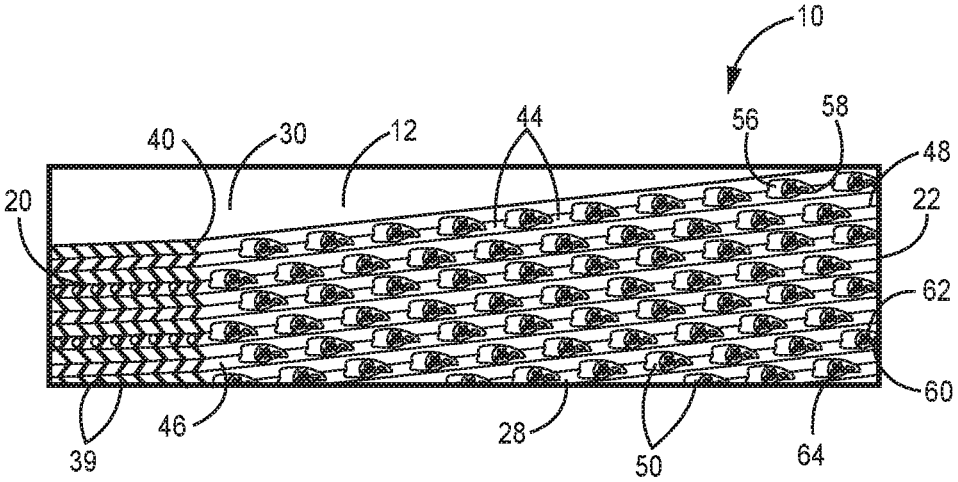
FIG. 2 is a cross-sectional view of the heat exchanger from FIG. 1 taken along line A-A.

FIG. 2 is a cross-sectional view of the heat exchanger from FIG. 1 taken along line A-A. As shown in FIG. 2, heat exchanger core 12 includes plurality of airfoils 50. Each airfoil 50 in the plurality of airfoils 50 includes leading edge 56, trailing edge 58, pressure side 60, suction side 62, and at least one secondary passage 64. Airfoils 50 are positioned within primary passage 44. Airfoils 50 include a base (not shown) on fourth side 26 and a tip (not shown) on third side 24. Each of airfoils 50 has a height extending from the base to the tip. Leading edge 56 extends from first fin 40 to second fin 42 along the height of each airfoil 50. Trailing edge 58 is opposite leading edge 56 and extends along the height of each airfoil 50. Each airfoil 50 has a chord length spanning from leading edge 56 to trailing edge 58. Pressure side 60 of each airfoil 50 extends between leading edge 56 and trailing edge 58 and extends along the height of each airfoil 50. Suction side 62 of each airfoil 50 is opposite of pressure side 60 and extends between leading edge 56 and trailing edge 58 and extends along the height of each airfoil 50. Each airfoil 50 has a thickness spanning from pressure side 60 to suction side 62. Each airfoil 50 is positioned so that leading edge 56 faces primary inlet 46 and trailing edge 58 faces primary outlet 48. As shown in FIG. 2, suction side 62 of airfoils 50 can face sixth side 30 and pressure side 60 of airfoils 50 can face fifth side 28.

Airfoils 50 are within each primary passage 44 to help guide the air that flows through primary passage 44 to limit the pressure drop through primary passage 44. Airfoils 50 also provide structural support throughout heat exchanger core 12 of heat exchanger 10 and provide a structure to house secondary passages 64. Moreover, the airfoil shape of airfoils 50 has a greater surface area within primary passage 44 than if secondary passages 64 were housed within simple tubes or pipes. The increased surface area of airfoils 50 provides more heat transfer surface between primary passage 44 and secondary passage 64. Therefore, the airfoil shape of airfoils 50 increases the heat transfer between the air flowing through primary passage 44 and the fluid flowing through secondary passage 64.

Each of secondary passages 64 extend through heat exchanger core 12 within one of airfoils 50 transverse primary passage 44. Each secondary passage 64 in airfoils 50 is a high-pressure passage designed to direct a high-pressure fluid through heat exchanger core 12 of heat exchanger 10. The fluid that flows through secondary passages 64 can be supercritical $CO_2$, or any other high-pressure fluid. As shown in FIG. 2, each airfoil 50 can include a plurality of secondary passages 64 extending from fourth side 26 to third side 24 of heat exchanger core 12. In other examples, each airfoil 50 can include a single secondary passage 64. When each airfoil 50 includes a plurality of secondary passages 64, each passage 64 of the plurality of secondary passages 64 can have a different shape. As shown in FIG. 2, some of secondary passages 64 are circular, and one of secondary passages 64 is triangular.

In operation, a low-pressure air, e.g., between 3-15 psi, enters heat exchanger core 12 through primary inlet 46. The low-pressure air flows through primary passage 44 between first fin 40 and second fin 42 and out of heat exchanger core 12 through primary outlet 48. Simultaneously, a high-pressure fluid, e.g., supercritical $CO_2$, supercritical He, or any other noble gas, and any other low, mid, and high-pressure refrigerants, flows within inlet 72 of header 70 and is distributed to outlets 76 of header 70 via plenum 74 of header 70. Each outlet of outlets 76 is fluidically connected to one of secondary passages 64. The high-pressure fluid then flows through each secondary passage 64 in a direction that is transverse to the low-pressure air flowing through primary passage 44 and leaves heat exchanger core 12 through a high-pressure fluid header.

In one example, the low-pressure air can enter heat exchanger core 12 at a temperature greater than the temperature of the high-pressure fluid entering heat exchanger core 12. In this example, the heat will be transferred from the low-pressure air to the high-pressure fluid across airfoils 50. In another example, the low-pressure air can enter heat exchanger core 12 at a temperature lower than the temperature of the high-pressure fluid entering heat exchanger core 12. In this example, heat will be transferred from the high-pressure fluid to the low-pressure air across airfoils 50.

As discussed above, the shape of first fin 40 and second fin 42 and the shape of airfoils 50 aid in the additive manufacturing of heat exchanger 10. Heat exchanger 10 can be additively manufactured in a single manufacturing process using powder bed fusion, directed energy deposition, and or any other form of additive manufacturing. Heat exchanger 10 can be additively manufactured by first forming header 70 in a layer-by-layer process.

Next, heat exchanger core 12 can be formed using a layer-by-layer process. As discussed above, the corrugation of first fin 40 and second fin 42 helps with the additive manufacturing of heat exchanger core 12. This is because the corrugation of first fin 40 and second fin 42 is designed to prevent too much or too little hangover. For example, as shown in FIGS. 1 and 2, the corrugation has around a 45-degree angle when measured from a plane normal the build platform. Without these angles, first fin 40 and second fin 42 would require internal supports during additive manufacturing that would later need to be removed in an additional processing step. As discussed above airfoils 50 help with additive manufacturing heat exchanger 10 because airfoils 50 provide internal supports throughout the layer-by layer process as airfoils 50 extend through first fin 40 and second fin 42. After heat exchanger core 12 is formed using a layer-by-layer process, the other header, which can be similar to header 70 can be formed using a layer-by-layer process.

Figure 3:
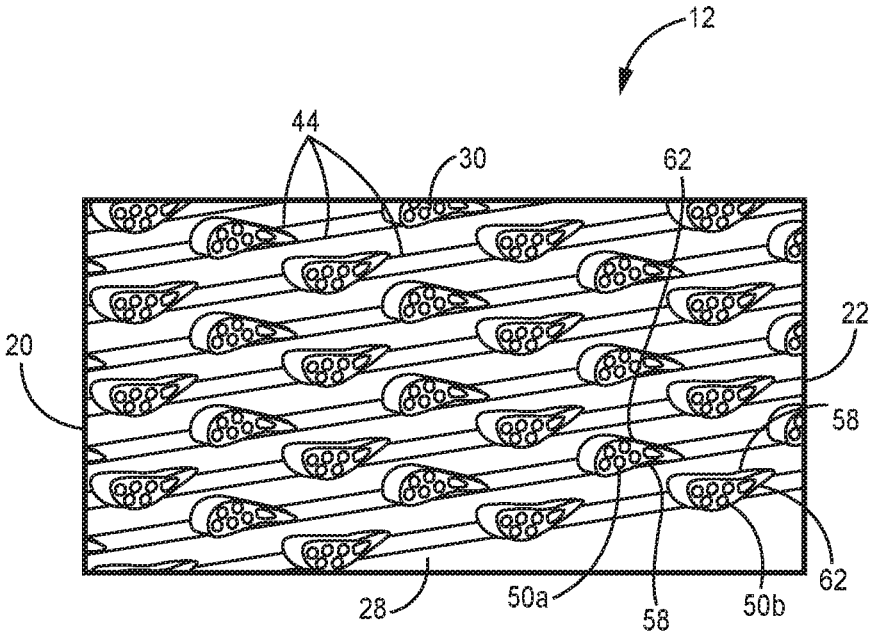
FIG. 3 is another cross-sectional view of another example of a heat exchanger.

FIG. 3 is a cross-sectional view of another example of heat exchanger 10. As shown in FIG. 3, a first airfoil 50*a* of airfoils 50 can have pressure side 60 facing fifth side 28 and suction side 62 facing sixth side 30 and a second airfoil 50*b* of airfoils 50 can have pressure side 60 facing sixth side 30 and suction side 62 facing fifth side 28. The alternating fashion of first airfoil 50*a* and second airfoil 50*b* helps minimize the resistance to flow of air flowing through primary passage 44.

Figure 4:
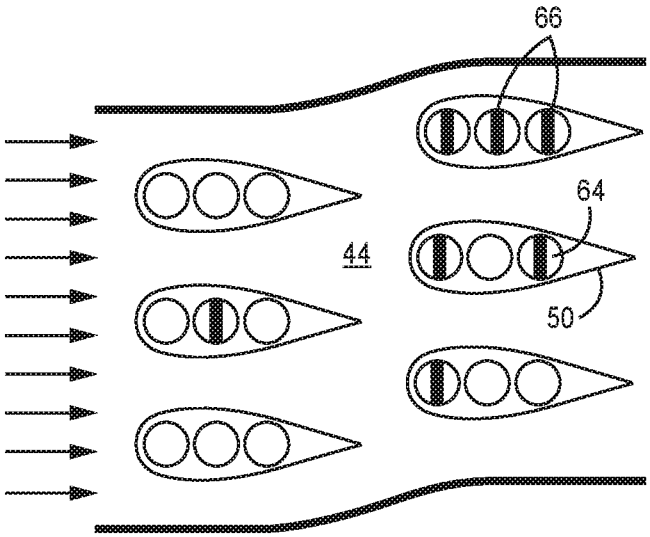
FIG. 4 is a schematic diagram of a plurality of airfoils including a plurality of passages within a primary passage.

FIG. 4 is a schematic diagram of primary passage 44 and airfoils 50 including secondary passages 64 within airfoils 50. As shown in FIG. 4, at least some of secondary passages 64 can include crossbar 66. Crossbar 66 increases the surface area within secondary passage 64 and thereby increases the surface area shared between secondary passage 64 and airfoil 50. The increased surface area between secondary passage 64 and airfoil 50 increases the heat transfer between air running through primary passage 44 and fluid running through secondary passage 64. Crossbar 66 also provides structural support within secondary passage 64 and airfoil 50. As shown in FIG. 4, all secondary passages 64 of airfoils 50 can include crossbar 66 or none of secondary passages 64 of airfoils 50 can include crossbar 66. As shown in FIG. 4, crossbar 66 is just one type of flow restrictor/support that can be within secondary passages 64.

Any shape, and or configuration of shapes can be used to restrict the flow of fluid and provide support within secondary passages 64. For example, secondary passages 64 can each include a matrix web to both increase the restriction of flow and supply structural support within secondary passages 64.

Figure 5:
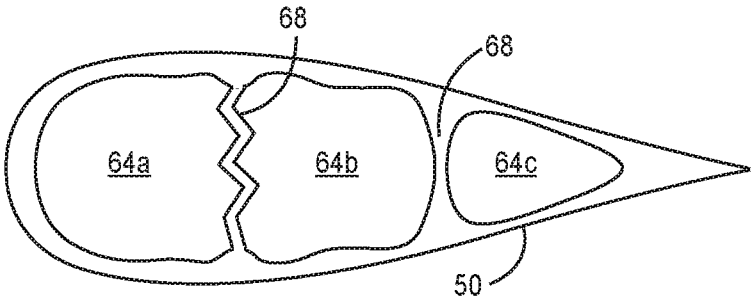
FIG. 5 is a cross-sectional view of an alternative design of secondary passages.

FIG. 5 is a cross-sectional view of an alternative design of secondary passages 64 within one of airfoils 50. As shown in FIG. 5, a first secondary passage $\mathbf{64}_a$ can have a first cross-sectional profile and a second secondary passage $\mathbf{64}_b$ can have a second cross-sectional profile. In example shown in FIG. 5, the first cross-sectional profile of the first secondary passage $\mathbf{64}_a$ can be different than the second cross-sectional profile of the second secondary passage $\mathbf{64}_b$. Moreover, airfoil 50 in FIG. 5 includes third secondary passage 64*c* with a third cross-sectional profile that is different than the first cross-sectional profile of first secondary passage $\mathbf{64}_a$ and the second cross-sectional profile of second secondary passage $\mathbf{64}_b$. In another example, the first cross-sectional profile of the first secondary passage $\mathbf{64}_a$ can be the same as the second cross-sectional profile of the second secondary passage $\mathbf{64}_b$.

As also shown in FIG. 5, airfoil 50 includes internal walls 68. Internal walls 68 segregate and fluidically isolate first secondary passage $\mathbf{64}_a$ from second secondary passage $\mathbf{64}_b$ and second secondary passage $\mathbf{64}_b$ from third secondary passage 64*c*. The shape of internal walls 68 can be altered to increase the surface area between airfoil 50 and secondary passages 64. For example, as shown in FIG. 5, one of internal walls 68 can be zig-zagged shaped to increase the surface area between airfoil 50 and secondary passages $\mathbf{64}_a$ and $\mathbf{64}_b$. In another example, internal walls 68 could be chevron shaped, corrugated, and or any other combination of shapes to increase the surface area between airfoil 50 and secondary passages $\mathbf{64}_a$, $\mathbf{64}_b$, and 64*c*. In yet another example, internal walls 68 can include textures, surface imperfections, or irregularities to increase the surface area between airfoil 50 and secondary passages $\mathbf{64}_a$, $\mathbf{64}_b$, and 64*c*.

Discussion of Possible Embodiments

The following are non-exclusive descriptions of possible embodiments of the present invention.

A heat exchanger includes a heat exchanger core. The heat exchanger core includes a first fin and a second fin. The second fin is spaced apart from the first fin. The heat exchanger core also includes a primary passage defined between the first fin and the second fin and extending through the heat exchanger core. The heat exchanger core also includes a plurality of airfoils extending through the first fin, the primary passage, and the second fin. At least one airfoil of the plurality of airfoils includes a secondary passage. The secondary passage extends through the heat exchanger core within the at least one airfoil transverse to the primary passage.

The heat exchanger of the preceding paragraph can optionally include, additionally and/or alternatively, any one or more of the following features, configurations and/or additional components:

the heat exchanger core further comprises: a first side; a second side opposite the first side; a third side extending from the first side to the second side; a fourth side opposite the third side and extending from the first side to the second side; a fifth side extending from the first side to the second side and extending from the third side to the fourth side; and a sixth side opposite the fifth side extending from the first side to the second side and extending from the third side to the fourth side, wherein the first fin and the second fin both extend from the first side to the second side and extend from the fifth side to the sixth side, and wherein the primary passage extends from the first side to the second side and from the fifth side to the sixth side;

the heat exchanger core further comprises: a primary inlet on the first side of the heat exchanger core; and a primary outlet on the second side of the heat exchanger core, wherein the primary passage extends from the primary inlet to the primary outlet;

each of the plurality of airfoils comprises: a base at the fourth side of the heat exchanger core; a tip at the third side of the heat exchanger core; and a height spanning from the base to the tip;

each of the plurality of airfoils comprises: a leading edge extending along the height of each airfoil of the plurality of airfoils; a trailing edge opposite the leading edge and extending along the height of each airfoil of the plurality of airfoils; and a chord length spanning from the leading edge to the trailing edge;

each of the plurality of airfoils comprises: a pressure side extending between the leading edge and the trailing edge and extending along the height of each airfoil of the plurality of airfoils; a suction side opposite the pressure side and extending between the leading edge and the trailing edge and extending along the height of each airfoil of the plurality of airfoils; and a thickness spanning from the pressure side to the suction side;

each of the plurality of airfoils is positioned so that the leading edge faces the primary inlet and the trailing edge faces the primary outlet;

the heat exchanger further comprises: a header on the third side of the heat exchanger core, wherein the header comprises: an inlet; a plenum; and an outlet, wherein the plenum is fluidically between the inlet of the header and the outlet of the header, and the outlet of the header is fluidically connected to the secondary passage;

the first fin and the second fin are corrugated; and/or a first airfoil of the plurality of airfoils has a pressure side facing the fifth side and a suction side facing the sixth side, and a second airfoil of the plurality of airfoils has a pressure side facing the sixth side and a suction side facing the fifth side.

A heat exchanger includes a heat exchanger core that includes a first fin extending in a first direction and extending in a second direction, a second fin extending in the first direction and extending in the second direction and spaced apart from the first fin in a third direction. The heat exchanger core also includes a primary passage extending between the first fin and the second fin from a primary inlet to a primary outlet. The heat exchanger core further includes a plurality of airfoils extending through the first fin, the primary passage, and the second fin. Each airfoil of the plurality of airfoils includes at least one secondary passage extending through each airfoil of the plurality of airfoils in the third direction. The heat exchanger also includes a header. The header includes an inlet, a plurality of outlets, and a plenum. The plenum is between the inlet and the plurality of outlets of the header. The plurality of outlets are fluidically connected to the at least one secondary passage of each airfoil of the plurality of airfoils.

The heat exchanger of the preceding paragraph can optionally include, additionally and/or alternatively, any one or more of the following features, configurations and/or additional components:

the first fin and the second fin are both corrugated;

each of the plurality of airfoils comprises: a leading edge facing the primary inlet of the heat exchanger core; and a trailing edge facing the primary outlet of the heat exchanger core;

the at least one secondary passage comprises a crossbar within the at least one secondary passage;

each airfoil of the plurality of airfoils comprises: a plurality of secondary passages, wherein the plurality of secondary passages comprises: a first secondary passage with a first cross-sectional profile; and a second secondary passage with a second cross-sectional profile, wherein the second cross-sectional profile is different from the first cross-sectional profile;

each airfoil of the plurality of airfoils further comprises: an internal wall segregating the first secondary passage from the second secondary passage, wherein the internal wall comprises a zig-zag profile;

the first fin and the second fin are corrugated as the first fin and the second fin extend in the second direction;

the heat exchanger core comprises: a first side; a second side opposite the first side; a third side extending from the first side to the second side; a fourth side opposite the third side extending from the first side to the second side; a fifth side extending from the first side to the second side and extending from the third side to the fourth side; and a sixth side opposite the fifth side extending from the first side to the second side and extending from the third side to the fourth side, wherein the primary inlet is on the fifth side and the primary outlet is on the sixth side;

each of the plurality of airfoils comprises: a leading edge facing the primary inlet of the heat exchanger core; and a trailing edge facing the primary outlet of the heat exchanger core; and/or a first airfoil of the plurality of airfoils, wherein the first airfoil comprises: a pressure side extending between the leading edge and the trailing edge of the first airfoil and along a height of the first airfoil; and a suction side opposite the pressure side between the leading edge and the trailing edge and along the height of the first airfoil, wherein the pressure side of the first airfoil faces the first side of the heat exchanger core and the suction side of the first airfoil faces the second side of the heat exchanger core; and a second airfoil of the plurality of airfoils, wherein the second airfoil comprises: a pressure side extending between the leading edge and the trailing edge of the second airfoil and along a height of the second airfoil; and a suction side opposite the pressure side of the second airfoil and between the leading edge of the second airfoil and the trailing edge of the second airfoil and along the height of the second airfoil, wherein the pressure side of the second airfoil faces the second side of the heat exchanger core and the suction side of the second airfoil faces the first side of the heat exchanger core.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A heat exchanger comprising:

a heat exchanger core, wherein the heat exchanger core comprises:

a first fin;

a second fin spaced apart from the first fin;

a primary passage defined between the first fin and the second fin and extending through the heat exchanger core; and a plurality of airfoils extending through the first fin, the primary passage, and the second fin, wherein at least one airfoil of the plurality of airfoils comprises:

a plurality of secondary passages, wherein the plurality of secondary passages extends through the heat exchanger core within the at least one airfoil transverse to the primary passage; and a crossbar within at least one of the plurality of secondary passages.

2. The heat exchanger of claim 1, wherein the heat exchanger core further comprises:

a first side;

a second side opposite the first side;

a third side extending from the first side to the second side;

a fourth side opposite the third side and extending from the first side to the second side;

a fifth side extending from the first side to the second side and extending from the third side to the fourth side; and a sixth side opposite the fifth side extending from the first side to the second side and extending from the third side to the fourth side, wherein the first fin and the second fin both extend from the first side to the second side and extend from the fifth side to the sixth side, and wherein the primary passage extends from the first side to the second side and from the fifth side to the sixth side.

3. The heat exchanger of claim 2 wherein the heat exchanger core further comprises:

a primary inlet on the first side of the heat exchanger core; and a primary outlet on the second side of the heat exchanger core, wherein the primary passage extends from the primary inlet to the primary outlet.

4. The heat exchanger of claim 3, wherein each of the plurality of airfoils comprises:

a base at the fourth side of the heat exchanger core;

a tip at the third side of the heat exchanger core; and a height spanning from the base to the tip.

5. The heat exchanger of claim 4, wherein each of the plurality of airfoils comprises:

a leading edge extending along the height of each airfoil of the plurality of airfoils;

a trailing edge opposite the leading edge and extending along the height of each airfoil of the plurality of airfoils; and a chord length spanning from the leading edge to the trailing edge.

6. The heat exchanger of claim 5, wherein each of the plurality of airfoils comprises:

a pressure side extending between the leading edge and the trailing edge and extending along the height of each airfoil of the plurality of airfoils;

a suction side opposite the pressure side and extending between the leading edge and the trailing edge and extending along the height of each airfoil of the plurality of airfoils; and a thickness spanning from the pressure side to the suction side.

7. The heat exchanger of claim 6, wherein each of the plurality of airfoils is positioned so that the leading edge faces the primary inlet and the trailing edge faces the primary outlet.

8. The heat exchanger of claim 7, wherein the heat exchanger further comprises:

a header on the third side of the heat exchanger core, wherein the header comprises:

an inlet;

a plenum; and an outlet, wherein the plenum is fluidically between the inlet of the header and the outlet of the header, and the outlet of the header is fluidically connected to at least one of the plurality of secondary passages.

9. The heat exchanger of claim 8, wherein the first fin and the second fin are corrugated.

10. The heat exchanger of claim 5, wherein a first airfoil of the plurality of airfoils has a pressure side facing the fifth side and a suction side facing the sixth side, and a second airfoil of the plurality of airfoils has a pressure side facing the sixth side and a suction side facing the fifth side.

11. A heat exchanger comprising:

a heat exchanger core, wherein the heat exchanger core comprises:

a first fin extending in a first direction and extending in a second direction;

a second fin extending in the first direction and extending in the second direction, and spaced apart from the first fin in a third direction;

a primary passage extending between the first fin and the second fin from a primary inlet to a primary outlet; and a plurality of airfoils extending through the first fin, the primary passage, and the second fin, wherein each airfoil of the plurality of airfoils comprises:

a plurality of secondary passages, wherein the plurality of secondary passages comprises:

a first secondary passage with a first cross-sectional profile;

a second secondary passage with a second cross-sectional profile, wherein the second cross-sectional profile is different from the first cross-sectional profile; and an internal wall segregating the first secondary passage from the second secondary passage, wherein the internal wall comprises a zig-zag profile; and a header, wherein the header comprises:

an inlet;

a plurality of outlets; and a plenum between the inlet and the plurality of outlets of the header, wherein the plurality of outlets are fluidically connected to the at least one secondary passage of each airfoil of the plurality of airfoils.

12. The heat exchanger of claim 11, wherein the first fin and the second fin are both corrugated.

13. The heat exchanger of claim 12, wherein each of the plurality of airfoils comprises:

a leading edge facing the primary inlet of the heat exchanger core; and a trailing edge facing the primary outlet of the heat exchanger core.

14. The heat exchanger of claim 13, wherein at least one secondary passage of the plurality of secondary passages comprises a crossbar within the at least one secondary passage.

15. The heat exchanger of claim 12, wherein the first fin and the second fin are corrugated as the first fin and the second fin extend in the second direction.

16. The heat exchanger of claim 15, wherein the heat exchanger core comprises:

a first side;

a second side opposite the first side;

a third side extending from the first side to the second side;

a fourth side opposite the third side extending from the first side to the second side;

a fifth side extending from the first side to the second side and extending from the third side to the fourth side; and a sixth side opposite the fifth side extending from the first side to the second side and extending from the third side to the fourth side, wherein the primary inlet is on the fifth side and the primary outlet is on the sixth side.

17. The heat exchanger of claim 16, wherein each of the plurality of airfoils comprises:

a leading edge facing the primary inlet of the heat exchanger core; and a trailing edge facing the primary outlet of the heat exchanger core.

18. The heat exchanger of claim 17, further comprising:

a first airfoil of the plurality of airfoils, wherein the first airfoil comprises:

a pressure side extending between the leading edge and the trailing edge of the first airfoil and along a height of the first airfoil; and a suction side opposite the pressure side between the leading edge and the trailing edge and along the height of the first airfoil, wherein the pressure side of the first airfoil faces the first side of the heat exchanger core and the suction side of the first airfoil faces the second side of the heat exchanger core; and a second airfoil of the plurality of airfoils, wherein the second airfoil comprises:

a pressure side extending between the leading edge and the trailing edge of the second airfoil and along a height of the second airfoil; and a suction side opposite the pressure side of the second airfoil and between the leading edge of the second airfoil and the trailing edge of the second airfoil and along the height of the second airfoil, wherein the pressure side of the second airfoil faces the second side of the heat exchanger core and the suction side of the second airfoil faces the first side of the heat exchanger core.

* * * * *